US009687415B2

(12) United States Patent
Rahman et al.

(10) Patent No.: US 9,687,415 B2
(45) Date of Patent: Jun. 27, 2017

(54) EXTRATHORACIC AUGMENTATION OF THE RESPIRATORY PUMP

(75) Inventors: Tariq Rahman, Wilmington, DE (US); Thomas H. Shaffer, Chadds Ford, PA (US); Marla R. Wolfson, Wyndmoor, PA (US)

(73) Assignee: THE NEMOURS FOUNDATION, Wilmington, DE (US)

( * ) Notice: Subject to any disclaimer, the term of this patent is extended or adjusted under 35 U.S.C. 154(b) by 1069 days.

(21) Appl. No.: 13/107,208

(22) Filed: May 13, 2011

(65) Prior Publication Data

US 2011/0313332 A1 Dec. 22, 2011

Related U.S. Application Data

(60) Provisional application No. 61/334,276, filed on May 13, 2010.

(51) Int. Cl.

| | |
|---|---|
| ***A61H 31/00*** | (2006.01) |
| ***A61H 9/00*** | (2006.01) |
| *A61H 31/02* | (2006.01) |

(52) U.S. Cl.

CPC ..... *A61H 31/00* (2013.01); *A61H 9/0071* (2013.01); *A61H 31/02* (2013.01);

(Continued)

(58) Field of Classification Search

CPC ..... A61H 9/0071; A61H 31/02; A61H 31/00; A61H 9/00; A61H 9/0007; A61H 9/005; F24F 9/00

(Continued)

(56) References Cited

U.S. PATENT DOCUMENTS 2,822,803 A * 2/1958 Huxley, III et al. ..... 601/43
3,000,379 A * 9/1961 Viers ..... 128/204.16

(Continued)

OTHER PUBLICATIONS

Mehta et al., "Noninvasive Ventilation", Am. J. Crit. Care Med. vol. 163, pp. 540-577 (2001).

*Primary Examiner* — Justine Yu
*Assistant Examiner* — Christopher Miller
(74) *Attorney, Agent, or Firm* — Drinker Biddle & Reath LLP

(57) ABSTRACT

Systems and methods for assisting respiration extrathoracically, particularly useful for augmenting respiration in neonatal patients, including providing a positive pressure to a torso area of a patient. The positive pressure may be delivered to the torso area of the patient while the torso area is exposed to an ambient pressure, such as by providing positive pressure with high frequency gas jets that are positioned in proximity to the torso area. The positive pressure may be delivered to different parts of the torso area of the patient at different times, such as by controlling gas jets independently. The positive pressure may also be controlled in coordination with a gas flow and concentration to the patient's airway, such as by increasing the positive pressure as a gas flow pressure delivered to the patient's airway is reduced. The gas flow to the patient's airway may be provided by, for example, a high-flow nasal cannula (HFNC) mechanism or a continuous positive airway pressure (CPAP) mechanism that is controlled in coordination with the positive pressure based upon a desired respiratory function of the patient. The control of the gas flow and the positive pressure may be based on an input of patient monitored parameters and/or calculated values based on the patient monitored parameters.

56 Claims, 5 Drawing Sheets

(52) U.S. Cl.
CPC ..... *A61H 2201/107* (2013.01); *A61H 2201/5002* (2013.01); *A61H 2201/5097* (2013.01); *A61H 2230/045* (2013.01); *A61H 2230/207* (2013.01); *A61H 2230/425* (2013.01)

(58) Field of Classification Search
USPC ..... 601/15, 16, 17, 41–44, 154, 156–161, 601/166, 168; 607/96, 104, 107
See application file for complete search history.

(56) References Cited

U.S. PATENT DOCUMENTS

| | | | | | |
|---|---|---|---|---|---|
| 3,333,581 | A * | 8/1967 | Robinson et al. | 601/44 |
| 3,505,989 | A * | 4/1970 | Truhan | 600/21 |
| 3,786,809 | A * | 1/1974 | Kitrilakis | 128/205.26 |
| 4,572,188 | A * | 2/1986 | Augustine et al. | 607/107 |
| 4,747,172 | A * | 5/1988 | Hohol | A61G 7/05 206/557 |
| 4,815,452 | A * | 3/1989 | Hayek | 601/44 |
| 5,044,364 | A * | 9/1991 | Crowther | 607/107 |
| 5,101,809 | A * | 4/1992 | Daffer et al. | 601/52 |
| 5,133,339 | A * | 7/1992 | Whalen et al. | 601/23 |
| 5,158,076 | A * | 10/1992 | Thomsen | 601/156 |
| 5,389,037 | A * | 2/1995 | Hale | 454/284 |
| 5,645,522 | A * | 7/1997 | Lurie et al. | 601/43 |
| 5,806,512 | A * | 9/1998 | Abramov et al. | 128/204.18 |
| 5,832,919 | A * | 11/1998 | Kano et al. | 128/205.26 |
| 6,030,353 | A * | 2/2000 | Van Brunt | 601/150 |
| 6,099,607 | A * | 8/2000 | Haslebacher | 55/356 |
| 6,142,149 | A * | 11/2000 | Steen | 128/204.23 |
| 6,367,476 | B1 * | 4/2002 | Conn | 128/205.26 |
| 6,461,315 | B1 * | 10/2002 | Gattinoni | 601/41 |
| 6,702,662 | B2 * | 3/2004 | Kristensson | 454/187 |
| D522,659 | S * | 6/2006 | Cote | D24/202 |
| 2002/0082468 | A1 * | 6/2002 | Goldberg et al. | 600/22 |
| 2003/0231962 | A1 * | 12/2003 | Gajewski et al. | 417/53 |
| 2004/0193077 | A1 * | 9/2004 | Hsu et al. | 601/49 |
| 2004/0230140 | A1 * | 11/2004 | Steen | 601/41 |
| 2004/0242955 | A1 * | 12/2004 | Koch | 600/22 |
| 2005/0061320 | A1 * | 3/2005 | Lee | A61M 16/00 128/204.18 |
| 2006/0079170 | A1 * | 4/2006 | Schmid et al. | 454/187 |
| 2008/0000477 | A1 * | 1/2008 | Huster | A61H 23/00 128/204.23 |
| 2008/0308106 | A1 * | 12/2008 | Augustine et al. | 128/205.29 |
| 2009/0036808 | A1 * | 2/2009 | Ki | 601/134 |
| 2010/0291859 | A1 * | 11/2010 | Kristensson et al. | 454/284 |
| 2010/0326442 | A1 * | 12/2010 | Hamilton et al. | 128/204.21 |
| 2011/0253136 | A1 * | 10/2011 | Sweeney | A61M 16/16 128/203.12 |

* cited by examiner

EXTRATHORACIC AUGMENTATION OF THE RESPIRATORY PUMP

This application claims priority to U.S. Provisional Patent Application No. 61/334,276, filed May 13, 2010, the disclosure of which is incorporated by reference herein in its entirety.

BACKGROUND OF THE INVENTION

Field of the Invention

The invention relates generally to devices and methods for assisting respiration extrathoracically and, more particularly, to extrathoracic assistance of respiration without sealing the torso area of the patient, such as premature infants, from an ambient pressure, and for assisting respiration extrathoracically in coordination with a positive airway pressure system.

Related Art

Respiratory distress can present a life-threatening condition to patients. Various systems and methods have been developed to deal with this condition including the use of constant negative pressure (CNP) ventilators, such as "iron lungs" and cuirass chambers, that compensate for a patient's loss of sufficient muscle control to force respiration. Mehta S, Hill N S. Noninvasive Ventilation. Am. J. Respir. Crit. Care Med., Feb. 1, 2001; 163(2): 540-577. CNP ventilators work on the principle of negative pressure applied externally to assist in breathing. For example, the iron lung required the patient to be encased in an airtight chamber with his/her head protruding and a seal placed between them and the chamber, whereas a cuirass provides a pressure seal around a portion of the patient's body, i.e. around the torso of the patient.

Such devices had significant drawbacks such as requirement of seals (which are not always effective), tissue damage from prolonged contact with the patient, reducing access to patients, and bulkiness. The use of such devices has been offset somewhat with the advent of positive airway pressure (PAP) through endrotracheal tubes, and continuous positive airway pressure (CPAP) devices, that may be used to improve respiratory function by decreasing the effort required for breathing. For example, during inspiration, the CPAP forces air into the lungs, and during expiration, the CPAP may assist in preventing bronchioles and alveoli from collapsing. However, the efficiency of CPAP devices alone can be limited by a number of factors including the physiological condition of the patient and the degree of assistance required. These problems can be particularly acute in patients, such as neonatal patients, with diminished lung compliance, a loss of functional residual capacity, and/or musculoskeletal limitations.

During normal breathing effort, the chest wall and abdomen both move out during inspiration and move in during expiration. This is considered a synchronous breathing pattern. If there is an inward motion of the chest wall during the inspiratory effort, with the paradoxical movement outward during expiration, it is a paradoxical or asynchronous breathing pattern.

This pattern occurs when the forces distending the lung (from diaphragmatic or respiratory muscle contraction) exceed the stability of the chest wall. As the diaphragm contracts, the negative forces pull the chest wall inward, creating an asynchronous chest and abdominal motion, and diminishing the area available for lung expansion.

Respiratory distress is a common problem for premature infants, and is related to diminished lung compliance (stiff lungs) related to the lack of surfactant and a loss of functional residual capacity (low lung volume, atelectasis). These factors increase the load on the respiratory muscles.

Additionally, developmental musculoskeletal limitations and added mechanical disadvantage due to the shape of the chest wall also predispose the premature infant to ventilatory challenge. The ribcage is more compliant in immature infants than older children or adults; thus, preterm infants are at greater risk for a paradoxical breathing pattern, particularly when they have stiff lungs, or respiratory distress syndrome (RDS). Incomplete ossification of the ribcage and underdevelopment of respiratory muscles predispose the thoracic wall to distortion since it is unable to resist the collapsing force created with inspiratory efforts. In this regard, the changes in the configuration of the chest wall with gestational age are also significant. The circumference of an infant's chest wall is more circular, and the ribs are placed more horizontally than those of the adult. This leaves the diaphragm and intercostal muscles at a mechanical disadvantage with respect to expanding thoracic volume. In addition, the chest wall of the infant is more cartilaginous, and therefore more compliant than in the adult. The relationship between high chest wall compliance and low lung compliance results in reduced thoracic volume, and thus reduced functional residual capacity (FRC). Additionally, respiratory muscle efforts can be inefficient and often ineffectual, causing distortion of the thoracic cage and retraction of the anterior chest wall rather than resulting in sufficient inspiratory volume. Together these issues result in the chest wall tending to collapse inward during inspiration as opposed to moving outward in phase with the abdomen.

In light of the above factors, a preterm infant will often breathe in a paradoxical pattern even in the face of a relatively low, or even a normal, inspiratory effort. In contrast, due to the more rigid chest wall, it would take a much larger inspiratory effort to create an inward or paradoxical motion of the chest wall during inspiration in a term infant or an adult.

Asynchronous breathing is inefficient. The loss of the stenting chest wall diminishes the tidal volume and FRC. This further increases the effort required to produce an adequate tidal volume, and the resultant increase in force generation may further increase asynchrony.

A number of surgical and ventilatory therapies have been used to support the anterior retraction of the chest wall to increase FRC and promote effective inspiration. In this regard, the "xiphoid hook," continuous negative extrathoracic pressure (CNP) and CPAP have been shown to reduce anterior chest wall retraction and improve respiratory indices in neonatal patients with RDS.

Although somewhat effective for this purpose, complications associated with tissue fragility are of concern with the hook approach. CNP ventilation typically requires complex ventilation units and has been associated with adverse effects. Thus, CPAP delivered by way of nasal prongs (NCPAP) is currently the most common means of pressure support in spontaneously breathing neonates. While improving FRC, chest wall distortion and oxygenation, NCPAP is not completely benign and has been associated with a number of adverse effects. Complications arising from the use of nasal cannulae for respiratory support include inconsistency in, and loss of, distending pressure with an open mouth or poorly fitting nasal prongs, nasal trauma and gaseous distention of the abdomen. In the case of mechanical ventilation, positive end-expiratory pressure (PEEP) supports lung volume and the relatively flaccid chest wall. High PEEP, although effective in increasing lung volumes, thus reducing atelectrauma, may impair cardiac output, contribute to ventilation-perfusion mismatch and ventilator-induced lung injury.

Bubble-CPAP (B-CPAP) has been used for the treatment of RDS in newborn infants for a number of years. In B-CPAP the expiratory limb of the CPAP circuit vents through an underwater seal. The resulting bubbles create pressure oscillations that are transmitted back to the airway opening. The pressure delivered has a broadband frequency composition (up to 15 Hz) and amplitude on the order of 4 cm of $H_2O$. Pillow and colleagues have shown that, compared with CPAP, B-CPAP promotes enhanced airway patency during treatment of acute postnatal respiratory disease in preterm lambs and may offer protection against lung injury. Pillow et al., Bubble Continuous Positive Airway Pressure Enhances Lung Volume And Gas Exchange In Preterm Lambs, Am J Repir Crit Care Med: 2007; 176; 63-69. They suggest that the mechanism leading to these effects may be a consequence of stochastic resonance resulting from the superposition of noise on the applied pressure signal. Other authors have suggested that the oscillatory component of the bubble waveform may augment gas exchange in a manner similar to that observed with high-frequency oscillatory ventilation (HFOV). Lee et al., A Comparison Of Underwater Bubble Continuous Positive Airway Pressure With Ventilator-Derived Continuous Positive Airway Pressure In Premature Neonates Ready For Extubation, Bioi Neonate. 1998; 73; 69-75.

It is also noted that the essential clinical criteria to remain on non-invasive respiratory support modes are effective spontaneous respiratory effort and $CO_2$ elimination. Hypercapnia, or apnea that may be secondary to hypercapnia, are the most common reasons for progressing to more invasive forms of ventilatory support. Therefore, if $CO_2$ retention during conventional non-invasive ventilation, such as CPAP, can be reduced or eliminated, many infants can be spared invasive mechanical ventilation and the associated potential lung injury and subsequent chronic lung and airway diseases.

In light of the above, there are still problems and disadvantages associated with the known methods of improving respiratory function, particularly in neonatal patients, including limited effectiveness of various PAP methodologies, adverse effects of prolonged treatment, and accessibility to patients undergoing CNP treatments.

BRIEF SUMMARY OF THE INVENTION

The invention provides systems and methods for assisting respiration extrathoracically, and, although not limited thereto, may be particularly useful for augmenting respiration in neonatal patients. Aspects of the invention include providing a positive pressure to a torso area of a patient that may assist in the respiratory function of the patient. The positive pressure may be delivered to the torso area of the patient in a non-invasive manner while the torso area is substantially exposed to an ambient pressure. The respiratory function may be further improved by controlling the delivery of the positive pressure, such as through the use of high frequency pressure pulses, varying the amount of applied pressure according to a desired respiratory function, and/or delivering positive pressure to different parts of the torso area of the patient at different times.

The positive pressure may also be controlled in coordination with a gas flow and concentration that is provided to the patient's airway. The gas flow to the patient's airway may be provided, for example, by a continuous positive airway pressure (CPAP) or high-flow nasal cannula (HFNC) mechanism, that is controlled in coordination with the positive pressure based upon a desired respiratory function of the patient. The control of the gas flow and the positive pressure may be based on an input of patient monitored parameters and/or calculated values based on the patient monitored parameters.

Accordingly, an external device of the invention may allow for improving respiratory function and lung volume without the need for surgical approaches or complex, invasive ventilatory support. The external device may advantageously be used to provide synchronized high frequency vibration to the thoracic cavity. Aspects of the invention may include an external, non-invasive, ventilatory-assist pressure delivery mechanism that may be used to improve functional residual capacity (FRC), respiratory mechanics, and gas exchange. Additionally, by cycling external forces, which can be higher than internally applied forces, it may be possible to augment ventilation and reduce or eliminate the need for intubation and mechanical ventilatory support under certain circumstances. For example, the high frequency pulses may be applied through jets having two different mean pulses that may be coordinated with two CPAP pressures to enhance respiration. By altering the external and internal pressures, the patient's respiratory system is subjected to lower pressure, without the need for an endrotracheal tube, thereby minimizing the risk of damage to the lungs and associated structures.

The invention may be implemented in a variety of ways. According to one aspect of the invention, a pressure delivery mechanism is configured to augment respiratory function of a patient by applying a positive exterior pressure to at least a portion of a torso area of the patient without sealing the portion of the patient's torso area from ambient pressure. In embodiments, the pressure delivery mechanism may be configured to apply positive pressure to the torso area without contacting the torso area of the patient.

In embodiments, the pressure delivery mechanism may include a plurality of gas outlets that are configured to apply pressurized gas to the portion of the torso area of the patient. The plurality of gas outlets may include at least one high frequency gas jet, e.g. two jets having different mean pressures. The pressure delivery mechanism may be configured to apply a high frequency positive exterior pressure to the torso area of the patient, such as, for example, via the high frequency gas jets, which may be coordinated CPAP pressures, as described below.

The gas outlets may be arranged in various configurations, and may be attached on to, in and/or about a support structure for substantially retaining the gas outlets in predetermined positions relative to the patient's torso area. In embodiments, the support structure may be adjustable such that the gas outlets may be substantially retained in predetermined adjustable positions. For example, at least a part of the support structure may be made from a material that is manually deformable to different positions. In alternative embodiments, the support structure may include an adjusting mechanism that is operable to change a height and/or angle of a portion of the support structure.

According to exemplary embodiments, a control system may regulate the output of the plurality of gas outlets, and may be configured to apply the pressurized gas to different areas of the torso area of the patient at different times. In embodiments, the control system may be operatively connected to the pressure delivery mechanism to control the pressure delivery mechanism based upon a desired respiratory function of the patient. The control system may be further configured to control a flow of a gas and concentration to the patient's airway in coordination with operation of the pressure delivery mechanism. The control system may be configured to control the pressure delivery mechanism and/or the flow of gas to the patient's airway based on patient monitored parameters including, for example, a respiratory rate, a tidal volume, a pressure development, a rib cage motion, and an abdominal motion of the patient. The control system may be configured to control the pressure delivery mechanism and/or the flow of gas to the patient's airway based on calculated values of patient monitored parameters such as, for example, phase angle and minute ventilation.

In embodiments, the apparatus may include a gas supply mechanism to control a gas flow and concentration to the patient's airway, and that is controlled in coordination with operation of the pressure delivery mechanism. For example, the gas supply mechanism may include a continuous positive airway pressure (CPAP) or high-flow nasal cannula (HFNC) mechanism, controlled in coordination with operation of the pressure delivery mechanism.

In embodiments, the control system may be configured to control the gas supply mechanism in coordination with the pressure delivery mechanism such that a gas supply pressure is decreased as a positive external pressure to the torso area is increased. For example, the control system may be configured to control the gas supply mechanism to provide approximately 5-8 cm $H_2O$ of pressure in a first state corresponding to an inhalation phase and approximately 2-5 cm $H_2O$ of pressure in a second state corresponding to an exhalation phase, and control the pressure delivery mechanism to deliver a relatively low pressure mean approximately 2-5 cm $H_2O$ with a superimposed high frequency amplitude +/−20 cm $H_2O$ at approximately 3-10 Hz in the first state and a relatively high pressure mean approximately 5-8 cm $H_2O$ with a high frequency amplitude +/−20 cm $H_2O$ at approximately 3-10 Hz in the second state. The high frequency (3-10 Hz) pressure oscillation may facilitate diffusion of gas exchange in addition to the bulk flow gas exchange associated with mean pressure changes. In embodiments, control of the gas supply mechanism and/or the pressure delivery mechanism may be automatically adjusted based on detected and/or stored values of patient vital signs, gas exchange, and pulmonary function. In embodiments, a temperature of a gas supplied by the pressure delivery mechanism may be approximately 25-27° C. In embodiments, a gas supplied by the gas supply mechanism may be 100% humidified and approximately 35-37° C. In embodiments, an oxygen concentration and/or flow of the gas supplied by the gas supply mechanism may be controlled based on pulse oximetry feedback.

According to another aspect of the invention, a method of assisting respiration includes positioning a portion of a patient's torso area in an environment open to ambient pressure. Embodiments may include applying positive pressure to the portion of the torso area of the patient during at least an exhalation phase and during a time in which the portion of the patient's torso area is substantially exposed to the ambient pressure. In embodiments, the positive pressure may be controlled to apply pressure to different areas of the torso area of the patient at different times.

Embodiments may include controlling the application of positive pressure to the torso area based on an input of patient monitored parameters including, for example, a respiratory rate, a tidal volume, a pressure development, a rib cage motion, and/or an abdominal motion. Embodiments may include controlling the application of positive pressure to the torso area based on calculated values of patient monitored parameters, such as phase angle and minute ventilation.

Embodiments may include a step of delivering a gas to the patient's airway, such as, for example, air, oxygen, and/or an oxygen enriched gas mixture. In embodiments, the step of controlling the application of positive pressure to the torso area and the delivery of gas to the patient's airway may be performed in coordination to augment the patient's respiratory function. For example, the positive pressure applied to the patient's torso area may be increased as a pressure of gas delivered to the patient's airway is reduced, such as during an exhalation phase.

In embodiments, the step of delivering a gas to the patient's airway may include delivering the gas via a continuous positive airway pressure (CPAP) or high-flow nasal cannula (HFNC) mechanism in coordination with the application of positive pressure to the portion of the torso area of the patient. The step of applying positive pressure to the portion of the torso area of the patient may include applying a high frequency gas pressure to the portion of the torso area of the patient, and blowing a gas directly against an area of the patient's skin. In embodiments, the step of applying a positive pressure to the portion of the patient's torso area may include applying the pressure from a plurality of gas outlets. An operating position of the gas outlets may be adjusted relative to the patient's torso area, such as to achieve a desirable operating distance and/or angle from the torso area of the patient.

In embodiments, the gas supply mechanism may be controlled in coordination with the pressure delivery mechanism according to a desired respiratory function, such as an inhalation and/or exhalation phase for the patient. For example, the pressure of gas delivered to the patient's airway may be controlled to provide approximately 5-8 cm $H_2O$ of pressure in a first state corresponding to an inhalation phase and approximately 2-5 cm $H_2O$ of pressure in a second state corresponding to an exhalation phase, and the positive pressure applied to the patient's torso area is control to deliver a relatively low pressure mean approximately 2-5 cm $H_2O$ with a high frequency amplitude +/−20 cm $H_2O$ at approximately 3-10 Hz in the first state and a relatively high pressure mean approximately 5-8 cm $H_2O$ with a high frequency amplitude +/−20 cm $H_2O$ at approximately 3-10 Hz in the second state. In embodiments, a flow rate of a HFNC may be set, for example, between 3-8 liters per minute (lpm).

According to other aspects of the invention, a method of assisting respiration includes positioning a portion of a patient's torso area in an environment open to ambient pressure, providing a pressure delivery mechanism in proximity to the torso area of the patient, providing a gas supply mechanism to deliver a gas to the patient's airway, and, while the portion of the patient's torso area is in the environment open to ambient pressure, controlling a pressure of the gas supply mechanism in coordination with a pressure provided by the positive pressure subsystem.

According to yet another aspect of the invention, an adjustable housing may be configured to be positioned in a number of predetermined positions with respect to a torso area of a patient, and a pressure delivery mechanism including a plurality of gas jets is supported by the housing. In embodiments, the jets may be configured to apply a positive pressure to at least a portion of the torso area of the patient, and at least two of the plurality of gas jets may be configured to be activated separately from one another. A control system may be operatively connected to the pressure delivery mechanism to control the pressure delivery mechanism based upon a desired respiratory function of the patient, and may be further operable to control the delivery of a gas to the patient's airway in coordination with the pressure delivery mechanism.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention claimed. The detailed description and the specific examples, however, indicate only preferred embodiments of the invention. Various changes and modifications within the spirit and scope of the invention will become apparent to those skilled in the art from this detailed description.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced. In the drawings.

DETAILED DESCRIPTION OF THE INVENTION

Figure 1:
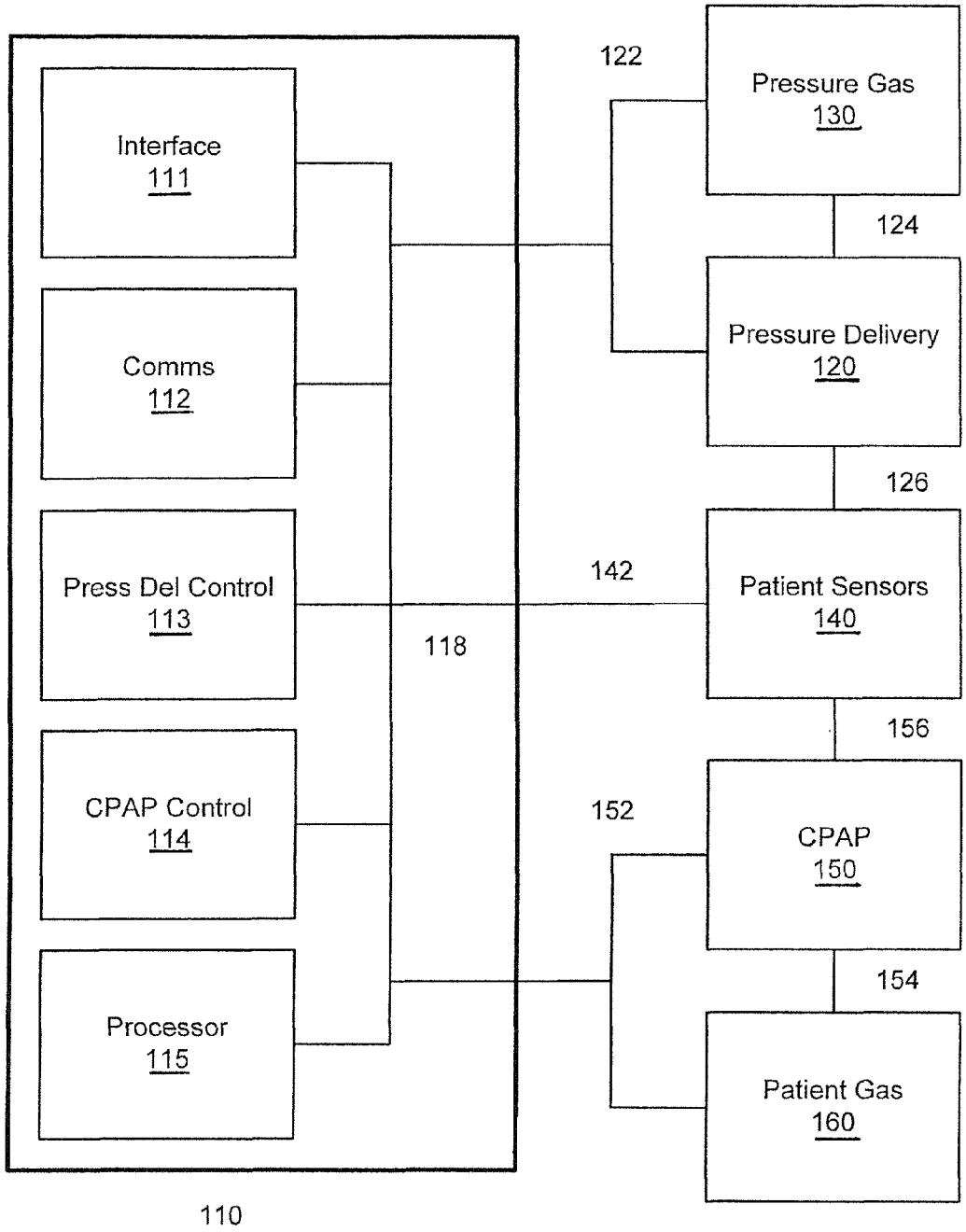
FIG. 1 is a schematic block diagram showing the exemplary component parts of an embodiment of a extrathoracic breathing augmentation system constructed according to the principles of the invention.

It is understood that the invention is not limited to the particular methodology, protocols, and reagents, etc., described herein, as these may vary as the skilled artisan will recognize. It is also to be understood that the terminology used herein is used for the purpose of describing particular embodiments only, and is not intended to limit the scope of the invention. It also is be noted that as used herein and in the appended claims, the singular forms "a," "an," and "the" include the plural reference unless the context clearly dictates otherwise. Thus, for example, a reference to "a lesion" is a reference to one or more lesions and equivalents thereof known to those skilled in the art.

Unless defined otherwise, all technical and scientific terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals reference similar parts throughout the several views of the drawings.

Moreover, provided immediately below is a "Definition" section, where certain terms related to the invention are defined specifically. Particular methods, devices, and materials are described, although any methods and materials similar or equivalent to those described herein can be used in the practice or testing of the invention. All references referred to herein are incorporated by reference herein in their entirety.

The terms "active agent," "drug," "therapeutic agent," and "pharmacologically active agent" are used interchangeably herein to refer to a chemical material or compound which, when administered to an organism (human or animal) induces a desired pharmacologic effect. Included are derivatives and analogs of those compounds or classes of compounds specifically mentioned that also induce the desired pharmacologic effect. In particular, the therapeutic agent may encompass a single biological or abiological chemical compound, or a combination of biological and abiological compounds that may be required to cause a desirable therapeutic effect.

By the terms "effective amount" or "therapeutically effective amount" of an agent as provided herein are meant a nontoxic but sufficient amount of the agent to provide the desired therapeutic effect. The exact amount required will vary from subject to subject, depending on the age, weight, and general condition of the subject, the severity of the condition being treated, the judgment of the clinician, and the like. Thus, it is not possible to specify an exact "effective amount." However, an appropriate "effective" amount in any individual case may be determined by one of ordinary skill in the art using only routine experimentation.

The terms "treating" and "treatment" as used herein refer to reduction in severity and/or frequency of symptoms, elimination of symptoms and/or underlying cause, prevention of the occurrence of symptoms and/or their underlying cause, and improvement or remediation of damage. Thus, for example, the present method of "treating" individuals afflicted with conditions that compromise airways, as the term "treating" is used herein, encompasses treatment of conditions that compromise airways in a clinically symptomatic individual.

The terms "condition," "disease" and "disorder" are used interchangeably herein as referring to a physiological state that can be detected, prevented or treated by the surgical techniques, devices and/or therapeutic agent as described herein.

The term "patient" as in treatment of "a patient" refers to a mammalian individual afflicted with or prone to a condition, disease or disorder as specified herein, and includes both humans and animals.

The following preferred embodiments may be described in the context of neonatal treatment, with corresponding therapeutic ranges and parameters. However, the invention is not limited to neonatal applications, and may be adapted to various clinical situations without departing from the overall scope of the invention.

As shown in FIG. 1, an exemplary system constructed according to aspects of the invention may include a control unit 110 with interface 111, communications device(s) 112, pressure delivery mechanism controller 113, patient gas controller 114, and processor(s) 115, connected by bus 118. Although shown in one exemplary control unit 110, the above parts may be arranged in other configurations and communicate by various means known by those of skill in the art, such as, for example, wired, radio frequency, and infrared communications. Interface 111 may provide access by a human operator, such as an attending physician or clinician to set operating parameters of the pressure delivery controller 113 to control a pressure delivery mechanism 120 and/or the patient gas controller to control a CPAP 150. The control unit may communicate with pressure delivery mechanism 102 via communication link 122, and may communicate with CPAP 150 via communication link 152. Various communications may be supported by one or more communication device(s) 112, such as, for example, modems, infrared devices, network ports, cards, and the like.

A pressure gas supply 130 may provide a gas to pressure delivery mechanism 120. In embodiments, pressure gas supply 130 may be a system including pressurized air cylinders. The pressure delivery mechanism 120 may be configured to adjust an amplitude and frequency applied to, for example, a pressurized gas blown against the torso area of the patient. Preferably, an amplitude of approximately +/−20 cm $H_2O$ at a frequency of approximately 3-10 Hz may be applied by the pressure delivery mechanism 120. The pressure delivery controller 113 may also be configured to adjust an external pressure applied to the patient's torso area by the pressure delivery mechanism 120. For example, the pressure delivery controller 113 may control a pressure mean between 2-8 cm $H_2O$. As discussed further below, the pressure delivery controller 113 may also be configured to control a sequencing of pressure applied to the torso area of the patient by pressure delivery mechanism 120. For example, pressure delivery mechanism 120 may include a plurality of high frequency gas jets that are configured to operate independently from one another, and that may be activated at different times to more effectively enhance a respiratory function.

Pressure gas supply 130 may be in communication with the control unit 110 via communication link 122, and may communicate independently with pressure delivery mechanism 120 via communication link 124. Therefore, control of the pressure delivery mechanism 120, such as controlling a pressure and frequency of gas jets, may be performed by communications to, or through, the pressure gas supply 130, or independently of the supply 130 via valves, restrictions and/or other means known in the art.

A patient gas supply 160 may provide a gas, such as air, oxygen, or an oxygen enriched mixture, to CPAP 150. Patient gas supply 160 may be in communication with the control unit 110 via communication link 152, and may communicate independently with CPAP 150 via communication link 154. Therefore, control of the CPAP, such as controlling a gas flow and concentration of gas delivered to the patient's airway, may be performed by communications to, or through, the patient gas supply 160, or independently of the supply 160.

The system may also include one or more patient sensor(s) 140, in communication with any of the control unit 110, pressure delivery mechanism 120 and/or CPAP 150. Sensors 140 may include sensors for detecting, for example, respiratory rate, tidal volume, pressure development, rib cage motion, abdominal motion, and/or oxygen saturation. Outputs from the sensors may be provided directly, or indirectly, to the control unit 110 via one or more communication link(s) 142, to the pressure delivery mechanism 120 via communication link(s) 126, and/or to the CPAP 150 via communication link(s) 156. Control unit 110 may calculate relevant values, such as phase angle, minute ventilation, and/or oxygen saturation, by processor(s) 115 based on the input patient sensor values. The control unit 110 may be configured to automatically adjust control of the pressure delivery mechanism 120 and/or the CPAP 150 based on one or more of the sensor inputs and/or the calculated values. For example, the external pressure applied by the pressure delivery mechanism may be increased according to a determination and/or indicators that suggest an exhalation phase for the patient. Similarly, the external pressure applied by the pressure delivery mechanism may be decreased according to a determination and/or indicators that suggest an inhalation phase for the patient. In embodiments, a phase angle measured by respiratory bands, such as respiratory inductance bands, may be used to indicate a phasic motion between the chest wall/rib cage (RC) and abdomen (Abd). In most cases, the phase angle should be 0 degrees, but may be acceptable up to 25 degrees. In embodiments, the control unit may be configured to adjust control of the pressure delivery mechanism 120 and/or the CPAP 150 when the phase angle exceeds a predetermined value, e.g. greater than 25 degrees. For example, embodiments may provide additional stabilization to the chest wall when the phase angle exceeds a predetermined value by increasing a CPAP pressure and decreasing an applied external pressure. Also, a RC contribution to respiration may be measured, and may be preferably maintained at approximately 40-50%. Should the percentage change beyond a predetermined range, the external pressure application may be adjusted by the control unit 110 to increase or decrease this proportionality.

The control unit 110 may be configured to adjust the gas flow and concentration provided to the patient's airway by the CPAP 150. For example, the gas flow may be decreased according to a determination and/or indicators that suggest an exhalation phase for the patient. Similarly, the gas flow may be increased according to a determination and/or indicators that suggest an inhalation phase for the patient. According to the coordinated use of a positive pressure mechanism, such as the pressure delivery mechanism 120, and other known PAP (airway) systems, such as an exemplary CPAP 150, it is possible to maintain lung volume stability, and wash away carbon dioxide, by oscillating the chest to augment ventilation.

As indicated above, the pressure delivery mechanism 120 may be controlled to provide an external positive pressure to the torso area of the patient. Preferably, a pressure field of 0-20 cm $H_2O$ may be applied on the chest wall and abdomen of the patient. Further details regarding an exemplary apparatus are provided in FIG. 2.

Figure 2:
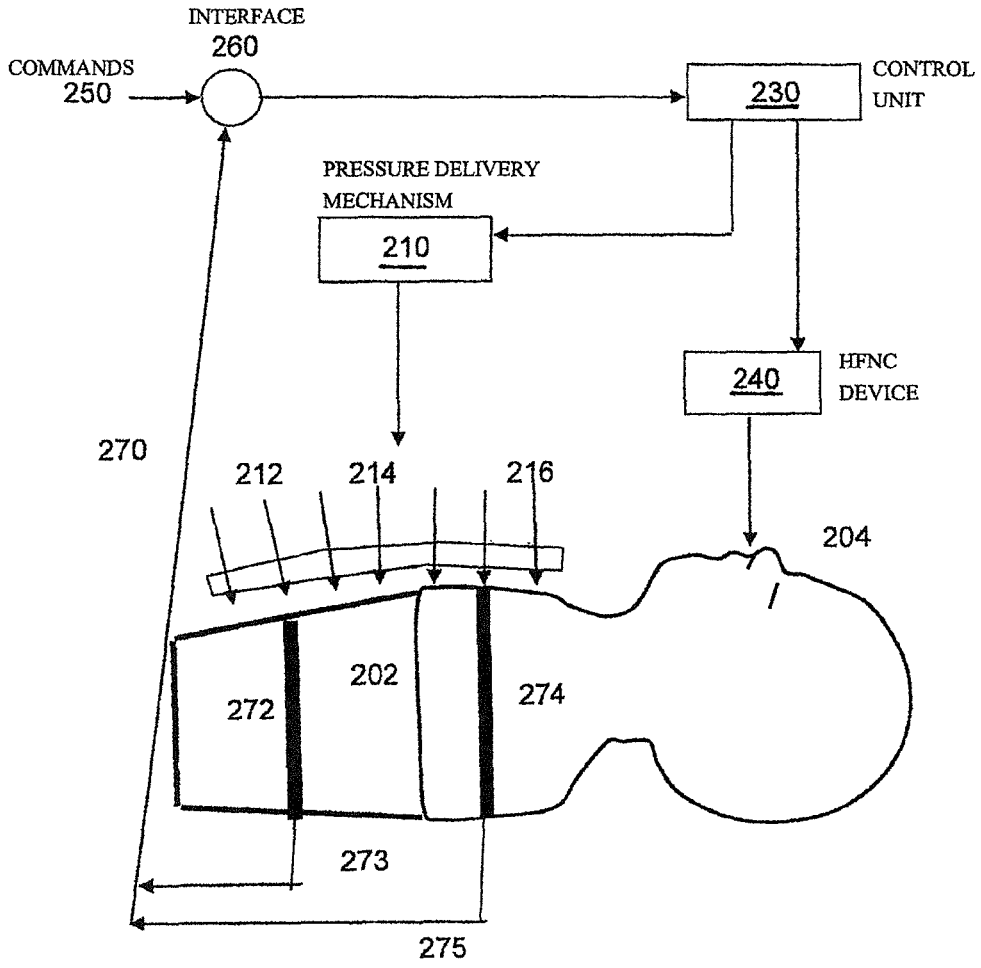
FIG. 2 is a schematic view showing an exemplary extrathoracic breathing augmentation apparatus of the invention positioned for use with a patient.

As shown in FIG. 2, an exemplary extrathoracic breathing augmentation apparatus according to aspects of the invention may include an interface 260 that may receive user commands 250 and/or sensor input data 270. The interface may provide commands and/or other information to a control unit 230, which may include similar components as control unit 110 described above. Control unit 230 may communicate with a pressure delivery mechanism 210 including high frequency gas jets 212, 214 and 216. In operation, the pressure delivery mechanism 210 may be adjustably positioned with respect to a patient's torso area 202 by any means known in the art such that the high frequency gas jets 212, 214 and 216 are maintained substantially at an effective operating distance from the patient's torso area 202. Preferably, this distance may be less than 1 cm, e.g. approximately 3 mm. The high frequency gas jets 212, 214 and 216 may be configured to operate at different times from one another, which may advantageously be used to induce and/or assist a tidal respiratory action. For example, during an exhalation phase, an external pressure provided by jet 212 may be increased first, followed by jet 214, followed by jet 216, resulting in a progressive expiration assistance.

The pressure delivery mechanism 210 may also include a microprocessor controlled air jet system, or an acoustic or ultrasound system, or other means known in the art, for applying amplitude and frequency to a gas jet.

Control unit 230 may also communicate with a HFNC device 240 that, in operation, may deliver a gas flow and concentration to a patient's airway by high flow nasal cannulae at 204. Alternatively, a CPAP such as shown in FIG. 1 may be provided. The HFNC 240 may be configured, for example, to provide a flow in excess of 2 liters per minute (lpm) of an oxygen enriched gas mixture, e.g., 2-8 lpm. It should be noted that, according to embodiments, a control unit such as control unit 230 may be configured to recognize and/or control more than one patient-gas delivery means such as CPAP, NCAP, B-CPAP, and/or HFNC devices. Thus, embodiments of the invention may be used in various contexts, including, for example, supporting different patient-gas delivery means that the clinician may have available, or as may be appropriate to the particular patient and/or condition.

The use of an HFNC device, such as shown in FIG. 2, may be beneficial, for example, in enhancing washout of nasopharyngeal dead space, i.e. the flushing of the nasopharyngeal cavity of expiratory gas. Washout of nasopharyngeal dead space has been found, in various procedures such as tracheal gas insufflation (TGI), to positively impact $CO_2$ removal along with oxygenation. In this regard, the use of HFNC compares favorably with CPAP methodologies in terms of reducing $CO_2$ retention. Thus, HFNC may be preferable in certain contexts, such as the treatment of infants, in reducing potential lung injury and subsequent chronic lung disease induced by mechanical ventilation.

The HFNC device 240 may be configured, for example, with a single prong (SP) relatively-high leakage around the nasal prong (HIGH LEAK) or a double prong (DP) relatively-low leakage around the nasal prongs (LOW LEAK). It has been found in other contexts that, as compared to CPAP and LOW LEAK, the partial pressure of carbon dioxide may be lower for reduced flow rates, e.g. <6 lpm, with a HIGH LEAK configuration, which may also be applied in the present subject matter. It is estimated that, in certain circumstances, a HIGH LEAK configuration may provide for improved washout of the nasopharyngeal cavity with an overall more effective gas exchange at a lower tracheal pressure.

Even without external pressure being applied to the subject, with HFNC, under both HIGH and LOW leak conditions, $PaCO_2$ and $PaO_2$ may potentially be improved in a somewhat flow dependent manner reflected by saturation curves, i.e. $PaCO_2$ decreasing with increasing flow until saturation, and $PaO_2$ increasing with increasing flow until saturation. These saturation relationships have been found in other contexts to be consistent with nasopharyngeal dead space washout related effects as demonstrated in the literature from TGI, which requires intubation.

In embodiments, a HFNC, such as HFNC 240, or other patient gas delivery means, may also be configured to adjust a temperature and/or humidity of the patient gas. This may be advantageous, for example, in providing adequately warmed and/or humidified gas to the conducting airways, thereby improving conductance and pulmonary compliance compared to dry, cooler gas. In particular, the provision of adequately warmed and humidified gas through the nasal pharynx may help to reduce the metabolic work associated with gas conditioning as is typically done through the design of the nasal pharynx, which facilitates humidification and warming of inspired gas by contact with the large surface area. By definition, this large wet surface area and nasopharyngeal gas volume can account for an appreciable resistance to gas flow. Under normal physiologic functioning of the respiratory tract, the nasal air passages warm inspiratory air from ambient to 37° C. and humidify the incoming air to 100% relative humidity (RH). Accordingly, in embodiments, a gas conditioning mechanism may be configured to adjust a temperature of the patient gas to approximately 37° C. and/or a humidity of the patient gas to approximately 100% RH.

Returning to FIG. 2, during inspiration the high frequency gas jets 212, 214 and 216 may be activated on at a relatively low force (amplitude), and high frequency, up to, for example, approximately 10 Hz. HFNC 240, or other CPAP etc., may be activated during inspiration at a relatively high pressure, preferably 5-8 cm $H_2O$. Thus, the two systems may be coordinated to act together in order to assist in inspiration, i.e. encouraging inspiration by increasing the pressure of gas flow to the airway and decreasing the resistive external force applied to the torso area of the patient. Alternatively, the HFNC may be operated at a consistent pressure, while varying the external pressure. In embodiments, HFNC may be implemented in a satisfactory, e.g. compared to CPAP, without changing pressure. When inspiratory gas is drawn across the large surface area of the nasopharynx, retraction of the nasopharyngeal boundaries results in a significant increase in inspiratory resistance compared to expiratory resistance. It has been found that, for example, the work of breathing for neonates with HFNC between 3-5 lpm was equivalent to that with nasal CPAP set to 6 cm $H_2O$. This reported equivalency was shown despite a significantly lower esophageal pressure (1.32±0.77 versus 1.76±1.46 cm $H_2O$; $p<0.05$). This result was also found in preclinical animal studies were airway pressure was directly measured during high flow conditions. Frizzola et al. Ped. Pulmonol. 46(1): 67-74, 2011.

During expiration, the jets 212, 214 and 216 may retain the high frequency component and add a relatively high force component to push air out. The relatively high force component may be applied in a wave along the abdomen and chest, such as by activating jets 212, 214 and 216 at different times. The HFNC 240, or other CPAP etc., may be controlled during expiration at a reduced level, for example between 2-5 cm $H_2O$, to allow $CO_2$ to exit. Like CPAP, HFNC may be controlled to provide a higher pressure (depending on patient size) during inhalation to produce, approximately, 5-8 cm $H_2O$ pressure, and lower pressure during exhalation to produce, approximately, 2-5 cm $H_2O$ pressure. Alternatively, such as in HIGH LEAK configurations, the HFNC may be operated at a constant pressure. In embodiments, the ratio of the inspiration phase time to expiration phase time may be approximately 1:2.

With further reference to FIG. 2, patient data may be provided by sensors 272 and 274, via communication links 273 and 275. For example, sensors 272, 274 may measure an abdominal motion and a rib cage motion, respectively. The system may use such information to measure and/or determine inspiration and expiration phases of the patient, and control the pressure delivery mechanism 210 and HFNC 240, or other CPAP etc., accordingly. Other sensors are also contemplated to inform these determinations and relevant control, such as sensors for determining respiratory rate, tidal volume, pressure development, and/or oxygen saturation. According to embodiments, oxygen saturation may be measured, such as by pulse oximetry, and compared to a predetermined range. Depending on an age of the patient, the predetermined range may be set around 90-92%. For younger infants the range may be lower, and for older infants and adults the range may be higher. If the oxygen saturation of the patient falls outside of the predetermined range, an oxygen concentration of patient gas may be changed as appropriate to increase or decrease oxygen saturation of the patient. Additionally, the control unit 230 may be configured to increase a patient gas pressure/concentration in coordination with a decrease in a mean jet extrathoracic pressure (MJEP) to increase oxygen saturation, and/or decrease the patient gas pressure/concentration in coordination with increasing MJEP to decrease oxygen saturation.

In embodiments, the control unit 230 may be configured to adjust control of the HFNC 240 and/or pressure delivery mechanism 210 based on a desired carbon dioxide elimination. For example, a frequency of changing the patient gas and MJEP ranges may be controlled in coordination in order to alter carbon dioxide elimination as measured by blood gas parameters. In embodiments, increasing the frequency and amplitude (i.e. a difference in mean pressures between HFNC, CPAP etc., and MJEP), may be used to promote carbon dioxide elimination. Also, the amplitude of the jet oscillations and frequency may be increased independently in order to promote carbon dioxide elimination.

According to the present subject matter, and particularly the open configuration of the pressure delivery mechanism 210, sensor placement, such as that described above, may be significantly improved over CNP systems that require seals around the body or torso of the patient. Additional details of an exemplary pressure delivery mechanism are described with reference to FIG. 3.

Figure 3:
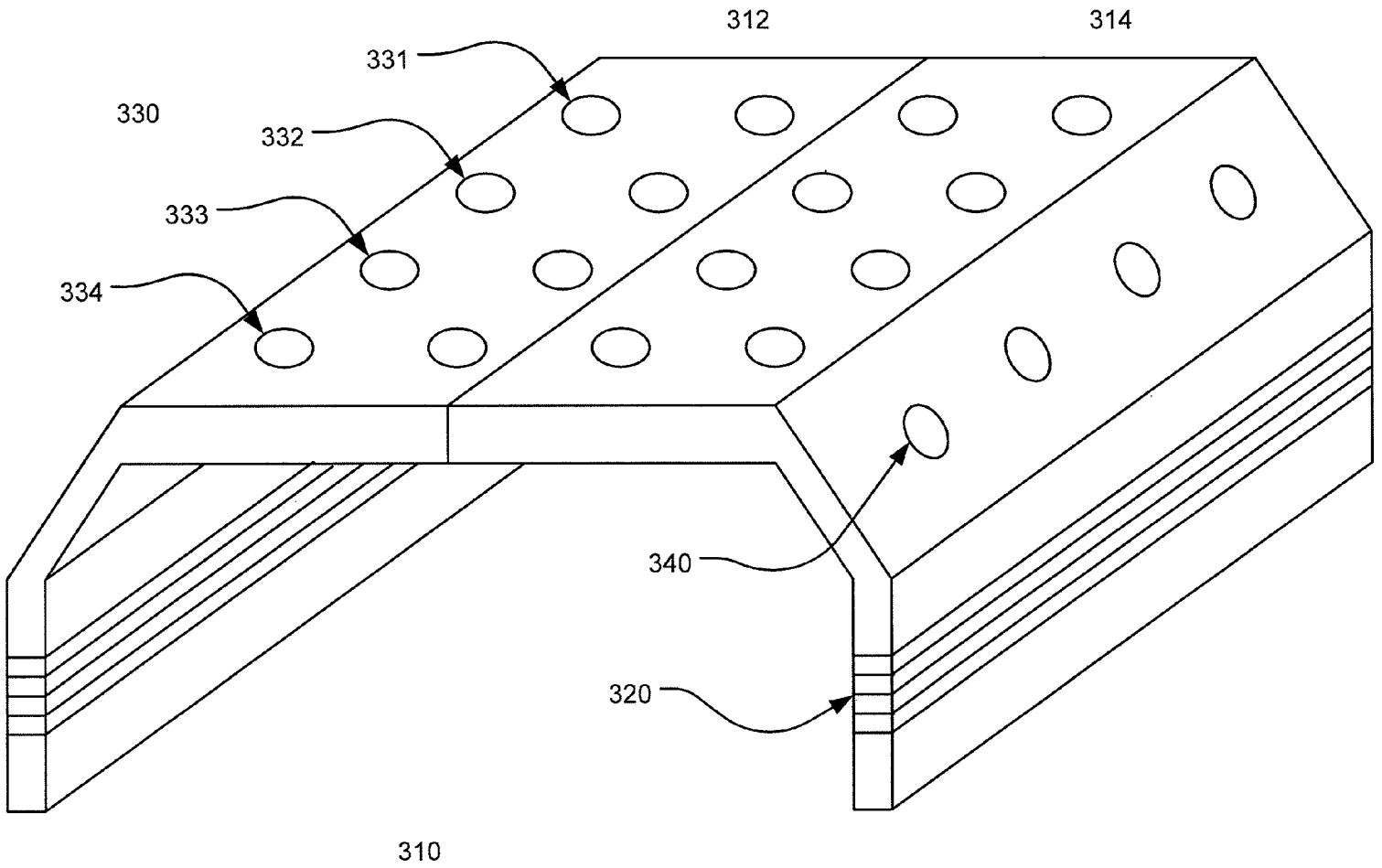
FIG. 3 is a schematic view of one embodiment of a pressure delivery mechanism of an extrathoracic breathing augmentation apparatus of the invention.

FIG. 3 shows an exemplary pressure delivery mechanism 310, which may be in the form of a jacket, and may include features similar to pressure delivery mechanism 210 described above. The pressure delivery mechanism 310 may include, or be attached to, a base unit (not shown) to stabilize the mechanism with respect to the patient. Pressure delivery mechanism 310 may include an assembly of parts, such as two complimentary halves 312 and 314, or be provided in a substantially unitary construction in the form of a jacket. The pressure delivery mechanism 310 may include a plurality of gas jets 330. As shown in FIG. 3, the gas jets 330 may be arranged in a top surface of the jacket and another set of gas jets 340 may be arranged on another surface of the jacket that is angled differently from the top surface. According to this configuration, external pressure may be advantageously applied to a torso area of the patient in a direction that is closer to normal than a single planar arrangement of gas jets or other pressure application mechanisms. By using gas jets, and the like, the pressure delivery mechanism may apply positive pressure without contacting the torso area of the patient. For example, a gas jet may be blown against the skin of the patient, such as the skin of the torso area, without physical contact of the device itself with the patient. This may be advantageous in preventing tissue damage, such as that caused by the prolonged physical contact required by many current treatments for respiratory distress.

Gas jets 330 may include a number of high frequency gas jets 331-334 that may be configured to activate at different times from one another. For example, each of gas jets 331-334 may be provided with individual gas supply lines with separate upstream controls, or gas jets 331-334 may be provided with individual activation mechanisms. Gas jets 331-334 may also include a microprocessor controlled air jet system, or an acoustic or ultrasound system, for applying amplitude and frequency to a gas jet. Each of gas jets 331-334 may have one or more corresponding gas outlets (not shown) on an interior surface of the pressure delivery mechanism 310.

Pressure delivery mechanism 310 may include an adjustable portion 320 that may allow the jacket to be positioned such that the gas jets 330 are maintained substantially at an effective distance from the patient during operation. Many ways of providing such adjustment are contemplated and will be apparent to those of skill in the art upon understanding the concepts described herein. For example, the adjustable portion 320, and/or other parts of a support housing, may be formed at least partly from a manually deformable, compressible and/or expandable material that, once adjusted, will substantially maintain its shape to resist an opposite force from the external force applied to the torso area of the patient. Alternatively, the jacket may have retaining means, such as pins, eyes, teeth and slots, that mechanically secure the adjusted support structure in predetermined positions. Such configurations may be advantageously used to adjust a height and/or angles of the halves 312, 314 with respect to the shape and size of a patient's torso area. In other embodiments, the adjustable portion 320 may include an adjustable mechanism that is operable to raise and lower the upper portion of the pressure delivery mechanism 310. The adjustable mechanism may be operable to position all, or part, of the pressure delivery mechanism 310 in predetermined, substantially fixed, positions, e.g. with pins and corresponding eyes, or may allow for a substantially continuous adjustment within a predetermined range, e.g. with a shaft, concentric sleeve and clamping mechanism. Adjustable mechanisms may be separately provided for different ends of the pressure delivery mechanism 310 such that an angle of a surface of the pressure delivery mechanism 310 may be set to a desired amount.

Figure 4:
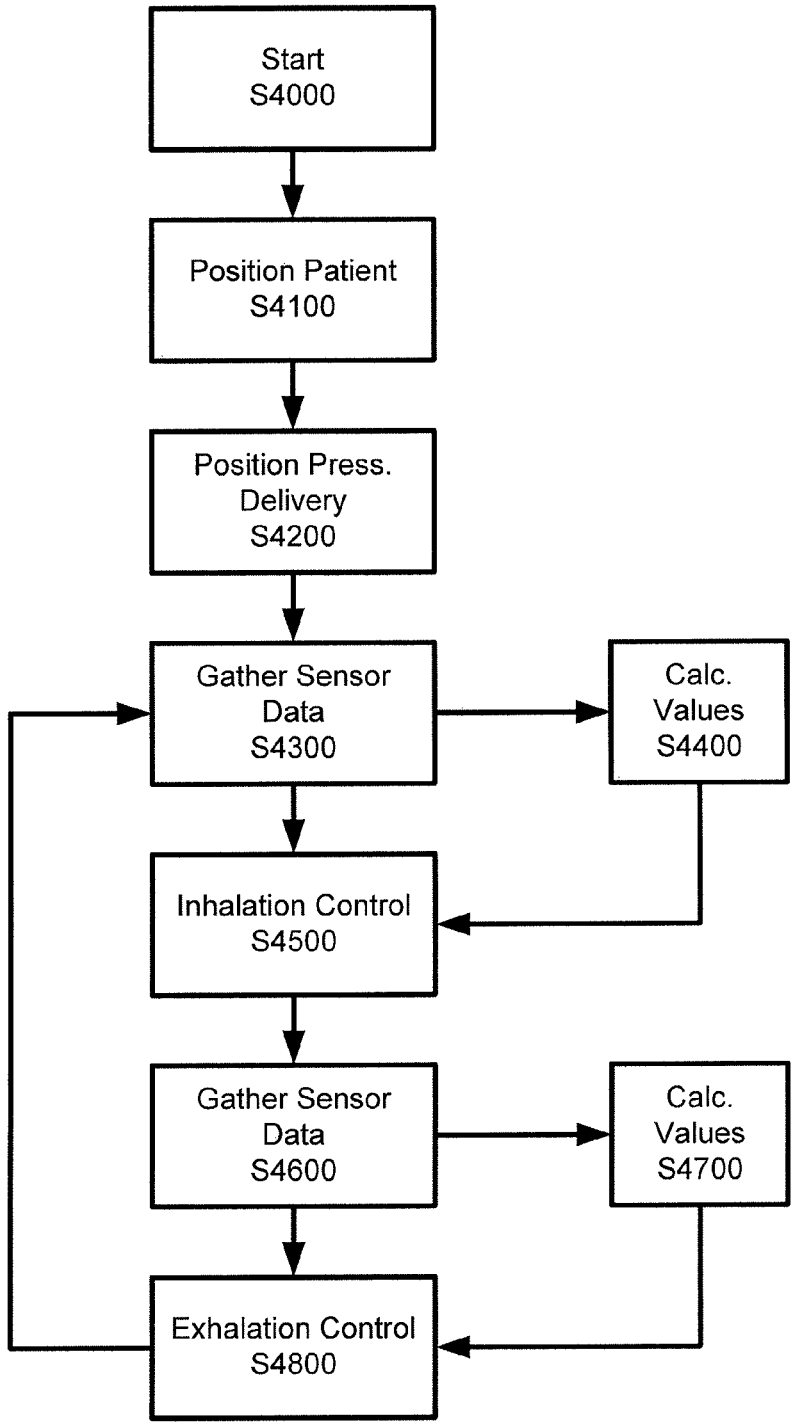
FIG. 4 is a flow chart depicting steps for operating an extrathoracic breathing augmentation apparatus according to the principles of the invention.
Figure 5:
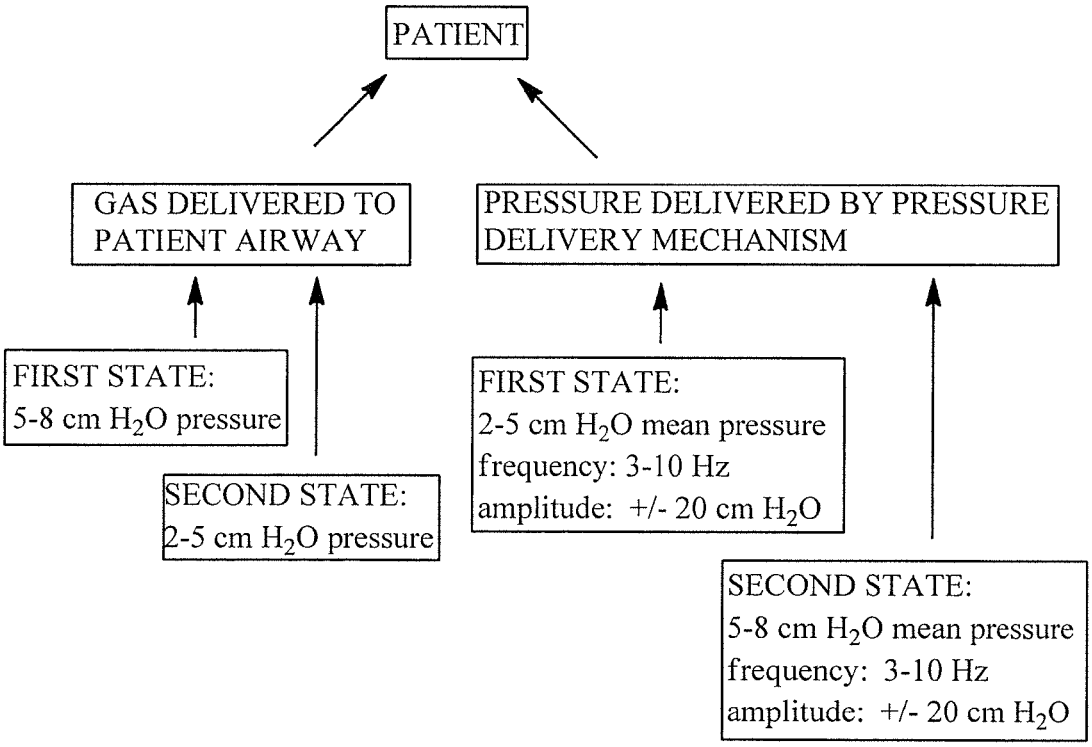
FIG. 5 is a schematic representation of the control of gas delivered to a patient airway and pressure delivered to the torso of the patient by a pressure delivery mechanism according to the present invention.

As shown in FIG. 4, an exemplary method for operating an extrathoracic breathing augmentation apparatus of the invention may start in S4000. The method may continue with S4100 during which a patient, for example a neonatal patient, may be positioned such that a portion of a patient's torso area is in an environment open to ambient pressure. In embodiments, this may include positioning the patient on a treatment table such that the exposed portion of the torso area, e.g. the chest and abdomen, are substantially exposed to the ambient pressure in the treatment room. Once the patient is positioned, the method may continue with S4200.

During S4200, a pressure delivery mechanism may be positioned with respect to the patient. For example, a pressure delivery mechanism, such as pressure delivery mechanism 310 shown in FIG. 3, may be positioned and substantially secured over a torso area of the patient. In embodiments, the pressure delivery mechanism may be positioned to present to at least part of the chest and abdomen of the patient. During S4200, the pressure delivery mechanism may also be adjusted to an effective position with respect to the torso area of the patient via an adjustable mechanism and the like. For example, in the case of using gas jets to apply the external positive pressure, a support structure of the gas jets may be adjusted such that the gas jets substantially maintain an operating distance of less than 1 cm, e.g. approximately 3 mm, from the skin of the patient.

Before, or during, S4200, sensors may be positioned with respect to, or attached to, the patient, and any necessary gas supply system may be provided to the patient, such as an HFNC, CPAP, or other patient gas delivery device, to provide a gas flow and concentration to the patient's airway. Once the pressure delivery mechanism is positioned, any necessary sensors are positioned or attached, and any required gas supply system is provided to the patient, the method may continue with S4300.

During S4300, sensor data and related patient parameters may be gathered such as, for example, a respiratory rate, a tidal volume, a pressure development, a rib cage motion, an abdominal motion, and other parameters useful for analyzing respiratory function. The patient parameters may be used to determine or establish a respiratory function of the patient, for example an inhalation or exhalation phase. If additional values are to be calculated based on the patient parameters, the method may optionally proceed with S4400 where values based on the patient parameters may be calculated such as, for example, phase angle and minute ventilation. During S4300 and S4400, one or more respiratory functions of the patient may be determined or established in order to inform the control of the pressure deliver mechanism and any gas supply system. In the example depicted in FIG. 4, an inhalation phase is determined to follow S4300 and S4400, however, as described further below, the initial phase could be determined to be an exhalation phase depending on the patient parameters and any calculated values. The method may continue with S4500.

During S4500, the pressure deliver mechanism and any gas supply system may be controlled in accordance with the determined respiratory function, in this case an inhalation phase. In embodiments, this may include applying a relatively low external pressure via the pressure deliver mechanism, e.g. approximately 2-5 cm $H_2O$, and a relatively high gas flow, e.g. approximately 5-8 cm $H_2O$, via a CPAP, or 2-8 lpm via a HFNC, and the like. As discussed herein, the external positive pressure may be applied to a part of the torso area of the patient, while the part of the torso area is substantially exposed to an ambient pressure. In embodiments, this may include the part of the torso area being exposed to a gas jet, such as a high frequency gas jet, or other pressure delivery mechanism, that applies a pressure greater than the ambient pressure without physically sealing the part of the torso area from the ambient pressure. The method may continue with S4600.

During S4600, which may be occurring substantially simultaneously with S4500, the system may continue to gather sensor data, as performed in S4300. In this regard, gathering of data may be performed in a substantially continuous manner, with the interpretative rules and/or necessary determinations switching between respiratory phases. If additional values are to be calculated based on the patient parameters, the method may optionally proceed with S4700 where values based on the patient parameters may be calculated such as, for example, phase angle and minute ventilation. During S4600 and S4700, a respiratory function of the patient may be determined or established in order to inform the control of the pressure deliver mechanism and any gas supply system. In the exemplary steps depicted in FIG. 4, the end of an inhalation phase and the subsequent beginning of an exhalation phase are determined. The method may continue with S4800.

During S4800, the pressure deliver mechanism and any gas supply system may be controlled in accordance with the determined respiratory function, in this case an exhalation phase. In embodiments, this may include applying a relatively high external pressure via the pressure deliver mechanism, e.g. approximately 5-8 cm $H_2O$ and a relatively low gas flow, e.g. approximately 2-5 cm $H_2O$, via a CPAP, HFNC, and the like, dependent upon patient size (e.g. infants vs. adults) and the degree of respiratory dysfunction. In embodiments, the relatively high external positive pressure may be applied to the part of the torso area during a time in which the part of the torso area is substantially exposed to the ambient pressure as discussed herein.

The method may continue by returning to S4300 where sensor data may again be collected to determine a respiratory function, in this case the end of an exhalation phase and the beginning of an inhalation phase.

As discussed herein, the steps of S4500 and/or S4800 may include, for example, applying the positive pressure to different areas of the torso area of the patient at different times, applying a high frequency gas pressure to the portion of the torso area of the patient, such as an amplitude of approximately +/−20 cm $H_2O$ at approximately 3-10 Hz, and other related functions described herein. Additionally, control values for the pressure delivery mechanism and/or the gas supply, such as a HFNC, CPAP, etc., may be automatically adjusted based on patient parameters and/or calculated values. This may include adjusting timing, pressure, flow, gas concentration, etc., based on determinations regarding the respiratory function of the patient and the effectiveness of the treatment.

The description given above is merely illustrative and is not meant to be an exhaustive list of all possible embodiments, applications or modifications of the invention. Thus, various modifications and variations of the described methods and systems of the invention will be apparent to those skilled in the art without departing from the scope and spirit of the invention. Although the invention has been described in connection with specific embodiments, it should be understood that the invention as claimed should not be unduly limited to such specific embodiments. Indeed, various modifications of the described modes for carrying out the invention which are obvious to those skilled in the cellular and molecular biology fields, medical device field or related fields are intended to be within the scope of the appended claims.

The disclosures of all references and publications cited above are expressly incorporated by reference in their entireties to the same extent as if each were incorporated by reference individually.

What is claimed is:

1. An apparatus comprising:

a pressure delivery mechanism comprising a plurality of gas outlets, said pressure delivery mechanism configured to augment respiratory function of a patient by applying pulses of pressurized gas directly to and in contact with an uncovered portion of the frontal torso area of the patient exposed to ambient, said pulses being provided at a frequency of from about 3 to 10 Hz to vibrate the thoracic cavity of the patient, without the mechanism contacting the frontal torso area portion of the patient; and a gas supply mechanism configured to deliver gas to the patient's airway.

2. The apparatus of claim 1, further comprising a control system to regulate the output of said plurality of gas outlets and configured to apply the pressurized gas to at least one portion of the frontal torso area of the patient at a time different from the time of gas application to another portion of the frontal torso area.

3. The apparatus of claim 2, wherein said control system is operatively connected to said pressure delivery mechanism to control the pressure delivery mechanism based upon a selected respiratory function of the patient, in coordination with operation of said pressure delivery mechanism.

4. The apparatus of claim 3, wherein said control system is further configured to control said pressure delivery mechanism based on an input of patient monitored parameters including at least one of a respiratory rate, a tidal volume, a pressure development, a rib cage motion, and an abdominal motion.

5. The apparatus of claim 3, wherein said control system is further configured to control said pressure delivery mechanism based on calculated values of patient monitored parameters, the calculated values including at least one of phase angle and minute ventilation.

6. The apparatus of claim 1, further comprising a support structure configured for substantially retaining said gas outlets in predetermined adjustable positions over the patient's torso area.

7. The apparatus of claim 1, wherein said plurality of gas outlets includes at least one high frequency gas jet.

8. The apparatus of claim 1, wherein the gas supply mechanism is configured to control a gas flow and concentration to the patient's airway.

9. The apparatus of claim 8, further comprising a control system configured to regulate the positive exterior pressure provided by said pressure delivery mechanism and the gas flow and concentration to the patient's airway provided by said gas supply mechanism.

10. The apparatus of claim 9, wherein said control system is operable to regulate said gas supply mechanism to provide from 5 to 8 cm $H_2O$ of pressure in a first state corresponding to an inhalation phase and from 2 to 5 cm $H_2O$ of pressure in a second state corresponding to an exhalation phase, and to control said pressure delivery mechanism to deliver a mean pressure of from 2 to 5 cm $H_2O$ at a frequency of from 3 to 10 Hz and amplitude +/−20 cm $H_2O$ in the first state and a mean pressure of from 5 to 8 cm $H_2O$ at a frequency of 3 to 10 Hz and amplitude +/−20 cm $H_2O$ in the second state.

11. The apparatus of claim 8, wherein said gas supply mechanism includes a continuous positive airway pressure (CPAP) mechanism controlled in coordination with operation of said pressure delivery mechanism.

12. The apparatus of claim 8, wherein said gas supply mechanism includes a high-flow nasal cannula (HFNC) mechanism controlled in coordination with operation of said pressure delivery mechanism.

13. A method of assisting respiration, said method comprising the steps of:

positioning an uncovered portion of a patient's frontal torso area in an environment open to ambient and proximate to a plurality of gas outlets of a positive pressure device, wherein said plurality of gas outlets are configured for applying a positive pressure to the uncovered torso portion of the patient by applying pressurized gas directly to and in contact with said uncovered torso portion without the gas outlets contacting the frontal torso area; and applying positive pressure to the uncovered portion of the frontal torso area of the patient via the positive pressure device by applying pressurized gas directly to and in contact with said torso portion in pulses at a frequency of from about 3 to 10 Hz during at least an exhalation phase and during a time in which the portion of the patient's torso area in contact with the pressurized gas is exposed to the ambient without the gas outlets contacting the frontal torso area, to assist respiration of the patient by vibrating the thoracic cavity of the patient; and delivering gas to the patient's airway via a gas supply device.

14. The method of claim 13, further comprising the step of applying the positive pressure to at least one portion of the frontal torso area of the patient at a time different from the time of positive pressure application to another frontal portion of the torso area, via the positive pressure device.

15. The method of claim 13 further comprising the step of controlling the application of positive pressure to the frontal torso area via the positive pressure device based on an input of patient monitored parameters including at least one of a respiratory rate, a tidal volume, a pressure development, a rib cage motion, and an abdominal motion.

16. The method of claim 13 further comprising the step of controlling the application of positive pressure to the frontal torso area via the positive pressure device based on calculated values of patient monitored parameters, the calculated values including at least one of phase angle and minute ventilation.

17. The method of claim 13 further comprising the step of controlling the application of positive pressure to the frontal torso area via the positive pressure device and the delivery of gas to the patient's airway via the gas supply device in coordination to augment the patient's respiratory function.

18. The method of claim 17, wherein the pressure of gas delivered to the patient's airway is controlled to provide from 5 to 8 cm $H_2O$ of pressure in a first state corresponding to an inhalation phase and from 2 to 5 cm $H_2O$ of pressure in a second state corresponding to an exhalation phase, and the positive pressure applied to the patient's torso area is controlled to deliver a mean pressure of from 2 to 5 cm $H_2O$ at a frequency of from 3 to 10 Hz and amplitude +/−20 cm $H_2O$ in the first state and a mean pressure of from 5 to 8 cm $H_2O$ at a frequency of 3 to 10 Hz and amplitude +/−20 cm $H_2O$ in the second state.

19. The method of claim 13, wherein the positive pressure applied to the patient's frontal torso area is increased as a pressure of gas delivered to the patient's airway is reduced.

20. The method of claim 19, wherein said step of delivering a gas to the patient's airway includes delivering the gas via a continuous positive airway pressure (CPAP) mechanism in coordination with the application of positive pressure to the portion of the frontal torso area of the patient.

21. The method of claim 19, wherein said step of delivering a gas to the patient's airway includes delivering the gas via a high-flow nasal cannula (HFNC) mechanism in coordination with the application of positive pressure to the frontal torso area of the patient.

22. The method of claim 13, wherein said step of applying a positive pressure to at least a portion of the patient's frontal torso area comprises blowing a gas directly against an area of the patient's skin via the positive pressure device.

23. The method of claim 13, further comprising the step of adjusting an operating position of the gas outlets relative to the patient's torso area.

24. A method of assisting respiration extrathoracically, said method comprising the steps of:

positioning an uncovered portion of a patient's frontal torso area in an environment open to ambient;

providing a pressure delivery mechanism comprising a plurality of gas outlets positioned in proximity to the uncovered portion of the frontal torso area of the patient without contacting the frontal torso area, said gas outlets configured for applying pressurized gas directly to and in contact with said uncovered torso portion in pulses at a frequency of from about 3 to 10 Hz, to provide a positive pressure to the uncovered torso portion of the patient to assist respiration of the patient;

providing a gas supply mechanism to deliver a gas to the patient's airway; and while the uncovered portion of the patient's torso area in contact with the pressurized gas is in the environment open to the ambient and is not contacted by the pressure delivery mechanism, controlling a pressure of the gas supply mechanism in coordination with a pressure provided by a positive pressure subsystem.

25. An extrathoracic breathing augmentation apparatus comprising:

an adjustable housing configured to be positioned in a number of predetermined positions over a frontal torso area of a patient while the torso area is exposed to ambient; and a pressure delivery mechanism including a plurality of gas jets supported by said housing, said plurality of jets being configured to apply pressurized gas to and in contact with at least an uncovered portion of the frontal torso area of the patient without the jets contacting the uncovered portion, to augment the respiratory function of the patient, at least one gas jet of said plurality of gas jets being configured to provide gas pulses at a frequency of from about 3 to 10 Hz; and a control system operatively connected to said pressure delivery mechanism to control the pressure delivery mechanism based upon a selected respiratory function of the patient;

and a gas supply mechanism configured to deliver gas to the patient's airway;

wherein at least two of said plurality of gas jets are configured to be activated separately from one another.

26. The apparatus of claim 25, wherein said control system is further operable to control the delivery of the gas to the patient's airway in coordination with said pressure delivery mechanism.

27. The apparatus of claim 25, wherein the gas supply mechanism is configured to control a gas flow and concentration to the patient's airway.

28. The apparatus of claim 27, wherein said gas supply mechanism includes a continuous positive airway pressure (CPAP) mechanism.

29. The apparatus of claim 27, wherein said gas supply mechanism includes a high-flow nasal cannula (HFNC) mechanism.

30. The apparatus of claim 25, wherein said plurality of gas jets includes at least two high frequency gas jets configured to provide high frequency pulses about two different mean pressures, wherein the control system controls the delivery of the gas to the patient's airway in coordination with said pressure delivery mechanism such that two different pressures of gas delivered to the patient's airway are coordinated with the two different mean pressures of the high frequency gas jets.

31. An apparatus comprising:

a pressure delivery mechanism configured to augment respiratory function of a patient by applying a positive exterior pressure to an uncovered portion of a frontal torso area of the patient by blowing gas directly against the uncovered torso area portion in pulses at a frequency of from about 3 to 10 Hz without sealing the torso area portion which is contacted by the gas and without the mechanism contacting the frontal torso area; a gas supply mechanism configured to deliver gas to the patient's airway; and a control system operatively connected to said pressure delivery mechanism to control the pressure delivery mechanism based upon a selected respiratory function of the patient.

32. The apparatus of claim 31, wherein said pressure delivery mechanism includes a plurality of gas outlets that are configured to apply pressurized gas to the uncovered portion of the frontal torso area of the patient.

33. The apparatus of claim 32, wherein the control system also regulates the output of said plurality of gas outlets and is configured to apply the pressurized gas to different areas of the frontal torso area of the patient at different times.

34. The apparatus of claim 32, further comprising a support structure configured for substantially retaining said gas outlets in predetermined adjustable positions relative to the patient's frontal torso area.

35. The apparatus of claim 32, wherein said plurality of gas outlets include at least one high frequency gas jet.

36. The apparatus of claim 31, wherein the gas supply mechanism is configured to control a gas flow and concentration to the patient's airway.

37. The apparatus of claim 36, wherein the control system is configured to regulate the positive exterior pressure provided by said pressure delivery mechanism and the gas flow and concentration to the patient's airway provided by said gas supply mechanism.

38. The apparatus of claim 37, wherein said control system is operable to regulate said gas supply mechanism to provide from 5 to 8 cm $H_2O$ of pressure in a first state corresponding to an inhalation phase and from to 5 cm $H_2O$ of pressure in a second state corresponding to an exhalation phase, and to control said pressure delivery mechanism to deliver a mean pressure of from 2 to 5 cm $H_2O$ at a frequency of from 3 to 10 Hz and amplitude +/−20 cm $H_2O$ in the first state and a mean pressure of from 5 to 8 cm $H_2O$ at a frequency of 3 to 10 Hz and amplitude +/−20 cm $H_2O$ in the second state.

39. The apparatus of claim 36, wherein said gas supply mechanism includes a continuous positive airway pressure (CPAP) mechanism controlled in coordination with operation of said pressure delivery mechanism.

40. The apparatus of claim 36, wherein said gas supply mechanism includes a high-flow nasal cannula (HFNC) mechanism controlled in coordination with operation of said pressure delivery mechanism.

41. An extrathoracic breathing augmentation apparatus comprising:

an adjustable housing configured to be positioned in a number of predetermined positions over a frontal torso area of a patient while the torso area is exposed to ambient; and a pressure delivery mechanism including a plurality of gas jets supported by said housing, said plurality of jets being configured to apply a positive pressure to an uncovered portion of the torso area of the patient without the jets contacting the frontal torso area portion, to augment respiratory function of the patient by blowing gas against the uncovered torso area portion, at least one gas jet of said plurality of gas jets being configured to provide gas pulses at a frequency of from about 3 to 10 Hz;

a gas supply mechanism configured to deliver gas to the patient's airway; and a control system operatively connected to said pressure delivery mechanism to control the pressure delivery mechanism based upon a selected respiratory function of the patient.

42. The apparatus of claim 41, wherein the gas supply mechanism is configured to control a gas flow and concentration to the patient's airway.

43. A method of assisting respiration, said method comprising the steps of:

positioning an uncovered portion of a patient's frontal torso area in an environment open to ambient and proximate to a positive pressure device for applying a positive pressure to the torso of the patient without the positive pressure device contacting the frontal torso area;

applying positive pressure to the uncovered torso portion of the patient via the positive pressure device by blowing a first gas directly against the uncovered torso area portion in pulses at a frequency of from about 3 to 10 Hz during at least an exhalation phase and during a time in which the uncovered portion of the patient's torso area which is contacted by said gas is exposed to the ambient and is not in contact with the positive pressure device, wherein said positive pressure applied augments the respiratory function of the patient; and delivering a second gas comprising air, oxygen or an oxygen-enriched gas mixture to the patient's airway via a gas supply device.

44. The method of claim 43, further comprising the step of applying the positive pressure to different areas of the frontal torso area of the patient at different times via the positive pressure device.

45. The method of claim 43, further comprising the step of controlling the application of positive pressure to the frontal torso area via the positive pressure device and the delivery of gas to the patient's airway via the gas supply device in coordination to augment the patient's respiratory function.

46. The method of claim 43, wherein said step of blowing a gas against the patient's uncovered torso area portion via the positive pressure device comprises blowing the gas from a plurality of gas outlets included in the positive pressure device.

47. The method of claim 43, wherein the positive pressure applied to the patient's frontal torso area is increased as a pressure of the second gas delivered to the patient's airway is reduced.

48. The method of claim 47, wherein said step of delivering the second gas to the patient's airway includes delivering the gas via a continuous positive airway pressure (CPAP) mechanism in coordination with the application of positive pressure to the uncovered portion of the torso area of the patient.

49. The method of claim 47, wherein said step of delivering the second gas to the patient's airway includes delivering the gas via a high-flow nasal cannula (HFNC) mechanism in coordination with the application of positive pressure to the uncovered portion of the torso area of the patient.

50. A method of assisting respiration, said method comprising the steps of:

positioning an uncovered portion of a patient's frontal torso area in an environment open to ambient and proximate to a positive pressure device for applying a positive pressure to the uncovered portion of the frontal torso area of the patient, applying positive pressure to the uncovered portion of the frontal torso area of the patient via the positive pressure device, wherein said positive pressure applied augments the respiratory function of the patient, by blowing a gas directly against and in contact with the uncovered frontal torso area portion via the positive pressure device in pulses at a frequency of from about 3 to 10 Hz during at least an exhalation phase and during a time in which the uncovered portion of the patient's frontal torso area which is contacted by the gas is substantially exposed to the ambient and is not in contact with the positive pressure device, delivering gas to the patient's airway via a gas supply device;

controlling the application of positive pressure to the uncovered frontal torso area via the positive pressure device based on (i) an input of patient monitored parameters including at least one of a respiratory rate, a tidal volume, a pressure development, a rib cage motion, and an abdominal motion, or (ii) calculated values of patient monitored parameters, the calculated values including at least one of phase angle and minute ventilation.

51. An apparatus comprising:

a pressure delivery mechanism configured to augment respiratory function of a patient by applying a positive exterior pressure to at least an uncovered portion of a frontal torso area of the patient without contacting the uncovered torso area portion and without sealing the portion from ambient, said pressure delivery mechanism including a plurality of gas outlets that are configured to be positioned at an operating distance of less than about 1 centimeter from the patient's uncovered frontal torso area portion to apply pulses of pressurized gas at a frequency of about 3 to 10 Hz, to augment respiratory function of the patient;

a control system to regulate the output of said plurality of gas outlets and configured to apply the pressurized gas to different areas of the torso area of the patient at different times, said control system being operatively connected to said pressure delivery mechanism to control the pressure delivery mechanism based upon a selected respiratory function of the patient, and configured to control the delivery of a gas supplied to the patient's airway from a gas supply, in coordination with operation of said pressure delivery mechanism.

52. The apparatus of claim 51, wherein said control system is further configured to control said pressure delivery mechanism based on an input of patient monitored parameters including at least one of a respiratory rate, a tidal volume, a pressure development, a rib cage motion, and an abdominal motion.

53. The apparatus of claim 51, wherein said control system is further configured to control said pressure delivery mechanism based on calculated values of patient monitored parameters, the calculated values including at least one of phase angle and minute ventilation.

54. A method of assisting respiration, said method comprising the steps of:

positioning a portion of a patient's torso in an environment open to ambient pressure and proximate to a plurality of gas outlets of a positive pressure device, wherein said plurality of gas outlets are configured for applying a positive pressure to the torso portion of the patient by applying pressurized gas directly to said torso portion;

applying positive pressure to the portion of the torso area of the patient via the positive pressure device by applying pressurized gas directly to said torso portion during at least an exhalation phase and during a time in which the portion of the patient's torso area is substantially exposed to the ambient pressure, to assist respiration of the patient;

delivering a gas to the patient's airway via a gas supply device; and controlling the application of positive pressure to the torso area via the positive pressure device and the delivery of gas to the patient's airway via the gas supply device in coordination to augment the patient's respiratory function;

wherein the pressure of gas delivered to the patient's airway is controlled to provide from 5 to 8 cm $H_2O$ of pressure in a first state corresponding to an inhalation phase and from 2 to 5 cm $H_2O$ of pressure in a second state corresponding to an exhalation phase, and the positive pressure applied to the patient's torso area is controlled to deliver a mean pressure of from 2 to 5 cm $H_2O$ at a frequency of from 3 to 10 Hz and amplitude +/−20 cm $H_2O$ in the first state and a mean pressure of from 5 to 8 cm $H_2O$ at a frequency of 3 to 10 Hz and amplitude +/−20 cm $H_2O$ in the second state.

55. An apparatus comprising:

a pressure delivery mechanism configured to augment respiratory function of a patient by applying a positive exterior pressure to at least a portion of a torso area of the patient by blowing gas directly against the torso area without sealing the torso area portion which is contacted by the gas from ambient pressure;

a gas supply mechanism configured to control a gas flow and concentration to the patient's airway;

a control system operatively connected to said pressure delivery mechanism to control the pressure delivery mechanism based upon a selected respiratory function of the patient, wherein the control system is configured to regulate the positive exterior pressure provided by said pressure delivery mechanism and the gas flow and concentration to the patient's airway provided by said gas supply mechanism; and wherein said control system is operable to regulate said gas supply mechanism to provide from 5 to 8 cm $H_2O$ of pressure in a first state corresponding to an inhalation phase and from to 5 cm $H_2O$ of pressure in a second state corresponding to an exhalation phase, and to control said pressure delivery mechanism to deliver a mean pressure of from 2 to 5 cm $H_2O$ at a frequency of from 3 to 10 Hz and amplitude +/−20 cm $H_2O$ in the first state and a mean pressure of from 5 to 8 cm $H_2O$ at a frequency of 3 to 10 Hz and amplitude +/−20 cm $H_2O$ in the second state.

56. A method of assisting respiration, said method comprising the steps of:

positioning an uncovered portion of a patient's frontal torso in an environment open to the ambient and within an operating distance of less than about 1 centimeter from a plurality of gas outlets of a positive pressure device without the gas outlets contacting the uncovered torso portion; and applying positive pressure to the uncovered torso portion of the patient via the positive pressure device by applying pressurized gas from the plurality of gas outlets directly to and in contact with said uncovered torso portion in pulses at a frequency of about 3 to 10 Hz during at least an exhalation phase and during a time in which the uncovered torso portion is substantially exposed to the ambient, to assist respiration of the patient; and delivering gas to the patient's airway via a gas supply device.

* * * * *